US011697972B2

(12) United States Patent
Nease

(10) Patent No.: US 11,697,972 B2
(45) Date of Patent: Jul. 11, 2023

(54) CENTRALIZERS FOR PRODUCTION TUBING

(71) Applicant: 360 Research Labs, LLC, Midland, TX (US)

(72) Inventor: Mark Nease, Midland, TX (US)

(73) Assignee: 360 Research Labs, LLC, Midland, TX (US)

( * ) Notice: Subject to any disclaimer, the term of this patent is extended or adjusted under 35 U.S.C. 154(b) by 1 days.

(21) Appl. No.: 17/509,443

(22) Filed: Oct. 25, 2021

(65) Prior Publication Data

US 2023/0127866 A1 Apr. 27, 2023

(51) Int. Cl.
*E21B 17/10* (2006.01)
*E21B 19/24* (2006.01)

(52) U.S. Cl.
CPC ..... *E21B 17/1078* (2013.01); *E21B 17/10* (2013.01); *E21B 17/1042* (2013.01); *E21B 19/24* (2013.01)

(58) Field of Classification Search
CPC ... E21B 17/1078; E21B 17/10; E21B 17/1042; E21B 19/24
See application file for complete search history.

(56) References Cited

U.S. PATENT DOCUMENTS 3,938,853 A * 2/1976 Jurgens et al. ..... E21B 17/04 175/325.2
8,701,759 B1* 4/2014 Hansen et al. ..... E21B 17/1042 166/241.1
2017/0204685 A1* 7/2017 Gao et al. ..... E21B 17/1028
2021/0372214 A1* 12/2021 Alarfaj et al. ..... E21B 17/1078

* cited by examiner

*Primary Examiner* — Yong-Suk (Philip) Ro
(74) *Attorney, Agent, or Firm* — Vorys, Sater, Seymour and Pease LLP

(57) ABSTRACT

Centralizers for stabilizing production tubing within a well may include a mandrel for securing within a section of production tubing and having a gland mounting surface; a gland mounted to the gland mounting surface of the mandrel, and having a cylindrical body and two or more lobes extending radially outward from the cylindrical body and comprised of an abrasion resistant material. Downhole assemblies may include a production string receivable within a cased well; a tubing anchor catcher positioned within the production string; a downhole pump coupled to the production string and located axially below the tubing anchor catcher; and a centralizer coupled to the production string.

19 Claims, 4 Drawing Sheets

CENTRALIZERS FOR PRODUCTION TUBING

FIELD OF THE INVENTION

The presently disclosed subject matter relates to tubing centralizers for production strings and methods of using the same.

BACKGROUND OF THE INVENTION

When a subterranean well is drilled, the wellbore is often "cased" or lined with steel pipe called casing to keep the formation from caving in and filling the wellbore. When casing is installed across the producing formation, the desired casing interval will often be perforated to allow the produced fluids to enter the wellbore to be produced to the surface. Once a well has been established, pumping systems are often installed to retrieve fluid hydrocarbons, particularly when the fluids are highly viscous or under insufficient reservoir pressure to reach the surface.

Pumping systems may include a length of production tubing that is installed within the cased well and secured at the surface by a tubing hanger. The production tubing extends some distance downhole near the casing perforations and may be secured with a downhole tubing anchor catcher. In rod pump systems, a sucker rodstring is emplaced within the production tubing and connected to a pumping unit at the surface, while a downhole pump is installed in the pump seating nipple located in the bottom of the tubing string. Reciprocation of the rodstring actuates the downhole pump, driving produced fluids into an annulus created between the interior of the production tubing and the rodstring, and to storage vessels at the surface.

The tubing anchor catcher functions to reduce the reciprocating movement of the production tubing in response to movement of the rodstring. When unsecured, reciprocation of the production tubing may cause a number of complications, including reduced pump stroke length and production volume. Movement of production tubing can also cause contact and abrasive forces against the casing and/or rodstring, leading to mechanical damage of equipment and the formation of leaks in the production tubing and casing that reduce production efficiency.

Properly installed tubing anchor catchers can impart tension between the casing and production tubing, which can reduce movement during reciprocation of the rodstring and the associated mechanical contact damage. However, for practical reasons, the tubing anchor catcher is often installed as close above the top perforation of the top producing interval as possible to avoid formation solids from entering the wellbore, while the downhole pump is installed near the bottom of the producing interval to maximize recovery and minimize gas-related pumping inefficiency.

For small production intervals, movement of the production tubing between the tubing anchor catcher and downhole pump is minimal and there is less risk of leaks in casing and tubing, equipment damage, and reduced production. Longer sections of un-anchored production tubing may still be present when installed in larger production intervals, such as in the presence of a large producing zone, clusters of zones, or horizontal and deviated wellbores, which can increase the risk of production inefficiency and equipment failure.

SUMMARY OF THE INVENTION

In an aspect, the present disclosure is directed to centralizers for stabilizing production tubing within a well, the centralizers including: a mandrel for securing within a section of production tubing and having a gland mounting surface; a gland mounted to the gland mounting surface of the mandrel, and having a cylindrical body and two or more lobes extending radially outward from the cylindrical body and comprised of an abrasion resistant material.

In another aspect, the present disclosure is directed to downhole assemblies including: a production string receivable within a cased well; a tubing anchor catcher positioned within the production string; a downhole pump coupled to the production string and located axially below the tubing anchor catcher; and a centralizer coupled to the production string, the tubing centralizer comprising: a mandrel secured to the production tubing and providing a gland mounting surface; a gland mounted to the gland mounting surface and providing a cylindrical body and two or more lobes extending radially outward from the cylindrical body, wherein at least a portion of the gland is made of an abrasion resistant material.

DETAILED DESCRIPTION OF THE INVENTION

The present disclosure is directed to tubing centralizers for supporting production strings during hydrocarbon recovery operations. Particularly, tubing centralizers disclosed herein may be installed on production tubing emplaced within a wellbore to mitigate or eliminate failure modes associated with reciprocation of the production tubing in response to pumping system operations. In some cases, one or more tubing centralizers may be installed on a production string, such as between the tubing anchor catcher and the seating nipple of the downhole pump (sometimes referred to as the "tailpipe"), which can extend into and beyond perforated sections of cemented casing in a completed well. In addition to or as an alternative, one or more tubing centralizers may also be installed above the tubing anchor catcher to limit friction and production tubing damage.

Tubing centralizers disclosed herein incorporate replaceable glands mounted on a mandrel (that is also replaceable) and can be installed between the pins and collars of an existing tubing string without the need for modification or customization. The modular design may be deployed readily in the field. For example, tubing centralizers may be installed while tubing strings are assembled and emplaced within the well. Tubing centralizers may installed on a tubing string and re-used for multiple jobs. The modular nature of the tubing centralizers enables quick replacement of the gland and/or mandrel as needed. Glands can be installed multiple times on the original mandrels without the need for additional tooling or modification, which reduces the cost of servicing and operating the well.

Figure 1:
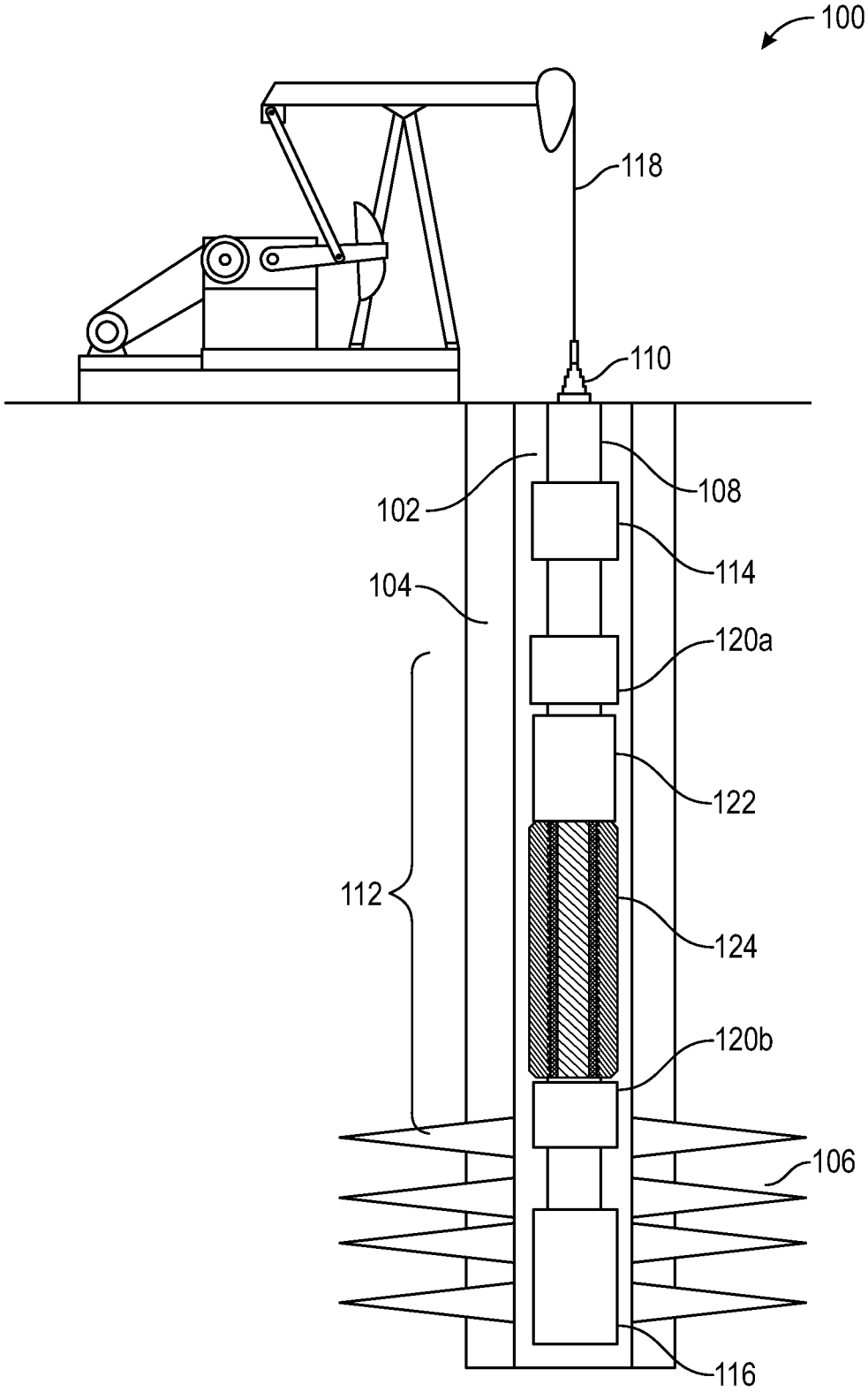
FIG. 1 is a diagram depicting an example embodiment in which a tubing centralizer of the present disclosure installed on a production string in a subterranean well.

With particular reference to FIG. 1, an example of a pump system 100 installed on a wellbore 102 having a cemented casing 104 is shown. During completion operations, the cemented casing 104 may be modified to include a perforated interval 106 in a producing section of the well 102. As installation of the pump system 100 proceeds, a production string 108 is emplaced within well 102 and secured to and extending from a wellhead 110. Production string 108 may include one or more tubing centralizers 112 of the present disclosure emplaced near a tubing anchor catcher 114, including between tubing anchor 114 and downhole pump 116 as shown. A sucker rodstring (not shown) is arranged within the production string 108 and is driven (e.g., reciprocated) by a pump jack 118 or other primary mover. During production, pump jack 118 drives the movement of the sucker rodstring, generating artificial lift that drives produced fluids from the perforated interval 106 through production string 108 to the surface. While production operation 100 utilizes a rod pump system, methods and apparatuses of the present disclosure may be adapted to other pump systems to mitigate production tubing damage.

Tubing centralizer 112 includes a mandrel 122 for securing within a section of production string 108 within wellbore 102 that is installed by couplings 120*a* and 120*b*, which may be threaded couplings (e.g., collars) or other unions. Mandrel 122 also includes a gland 124 mounted thereon. Gland 124 may be dimensioned to engage the inner radial surface of well casing 104 during and after installation, and thereby stabilize production string 108. For example, gland 124 may have an outer diameter equal to or greater than the inner diameter of the well casing 104 in some cases, such that the gland 124 engages the casing 104. The outer diameter of the gland 124 may also be less than the inner diameter of the well casing 104, such that contact only occurs during movement of the production string 108 (e.g., moving in response to reciprocation of the rodstring during production).

The gland 124 may be constructed from an abrasion resistant material and may be removed and replaced once worn by mechanical damage. Abrasion resistant materials may also include materials that are deformable or sacrificial, such as when the gland 124 encounters an obstruction during emplacement or removal. Gland 124 may be constructed from materials typically used in bushing and wearing parts. Suitable gland 124 manufacturing materials include polymers and copolymers incorporating two or more monomer types, such as nylons; polyethylene terephthalate; polyetheretherketones; degradable polymers such as polylactic acid, polyglycolic acid, polylactic-co-glycolic acid; polyurethane; synthetic and natural rubbers including isoprene rubber, butadiene rubber, acrylonitrile-butadiene copolymer rubber, styrene-butadiene copolymer rubber, and the like; fluoropolymers such as polytetrafluoroethylene; polyesters such as polymethylmethacrylate, polyvinyl alcohol, poly(vinyl formal), polyvinyl butyral, polyethylene terephthalate, and polybutyrene terephthalate; polyamides such as polyphenylene oxide, polycaprolactam and polyhexamethylene adipamide; thermoplastic resins; polycarbonates and blends such as polycarbonate/ABS resin, branched polycarbonate; polyacetals; polyphenylene sulfide; cellulose resin; open cell foams such as polyurethane foams; and other materials known in the pipeline industry for making plugs, wipers, darts, pigs, seals, and the like. Other suitable manufacturing materials for gland 124 include composites, ceramics, metals, and the like.

While only one tubing centralizer 112 is depicted in FIG. 1, production string 108 may alternatively include a plurality of tubing centralizers 112 interspersed between sections of production tubing for stabilization during and after installation within a well 102. Multiple tubing centralizers 112 may also be configured in series on production string 108. The number of tubing centralizers 112 and their respective spacing along the production tubing may be determined based on a number of considerations including the properties of each centralizer (e.g., the starting force, the drag force, and the like), the properties of the wellbore tubular (e.g., the sizing, the weight, and the like), and the properties of the wellbore through which the wellbore tubular is passing (e.g., the annular diameter difference, the tortuosity, the orientation of the wellbore, and the like). The number and the spacing of the tubing centralizers 112 along the production string 108 may vary based on the expected conditions within the wellbore.

Figure 2:
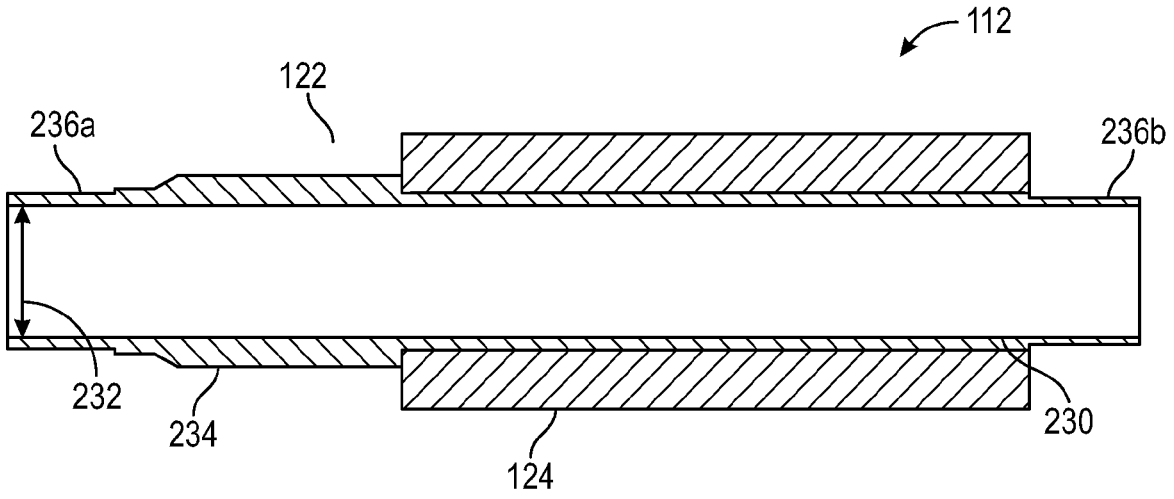
FIG. 2 is a cross section of a tubing centralizer in accordance with the present disclosure.

A cross-section of tubing centralizer 112 is shown in FIG. 2, which illustrates one configuration in which gland 124 is installed on a gland mounting surface 230 provided by mandrel 122. In some embodiments, as illustrated, gland mounting surface 230 may comprise an undercut or reduced-diameter section defined on mandrel 122. Accordingly, in such embodiments, gland mounting surface 230 may extend along only a portion of the length of mandrel 122. In other embodiments, however, gland mounting surface 230 may extend along the entire length of mandrel 122, without departing from the scope of the disclosure.

As illustrated, mandrel 122 is a cylindrical pipe having an inner diameter 232 that is compatible with other components in the production string 108. In FIG. 2, threaded ends 236*a* or 236*b* are shown as one method of installing the tubing centralizer 112 on production string 108, however, mandrel 122 may be adapted to use any suitable method of joining lengths of production tubing know in the art. While a multi-component tubing centralizer 112 is shown in which the gland 124 and mandrel 122 are separate components, it is also envisioned that the tubing centralizer 112 may be a monolithic (unitary) structure in which the mandrel 122 and gland 124 are constructed from the same material.

Gland 124 may be emplaced over the cylindrical surface of the mandrel undercut. There may be a close tolerance between the outer diameter of the mandrel 122 and the inner diameter of gland 124, but the tolerance may vary depending on application and the diameter of the retaining components (e.g., collars, shoulders). In some embodiments, gland 124 may be secured in place to mandrel 122 (i.e., stationary), or may alternatively be mounted to mandrel 122 such that it is free to rotate about the outer surface of the mandrel 122. The gland 124 may be secured to the mandrel 122 by any suitable method. In some cases, gland 124 may be secured to the exterior of mandrel 122 using one or more retaining collars or features, such as a shoulder 234, and/or as an undercut gland mounting surface 230, or combinations thereof. As shown in FIG. 2, gland 124 may be secured between the mandrel shoulder 234 and a collar (not shown) threaded to threaded end 236*b*, which axially secures the gland 124 and otherwise prevents gland 124 displacement along the length of the mandrel 122. Other mandrel 122 designs are possible, including designs in which the outside diameter that is consistent along its length (without shoulder or undercuts, for example). In some cases, gland 124 may be secured to the mandrel 122 by other methods such as one or more mechanical fasteners (e.g., screws, tabs, rivets, features on a retaining shoulder or collar, etc.), an interference or shrink fit, welding or brazing, or via a chemical-mediated bond (e.g., adhesive or bonding agent).

Figure 3:
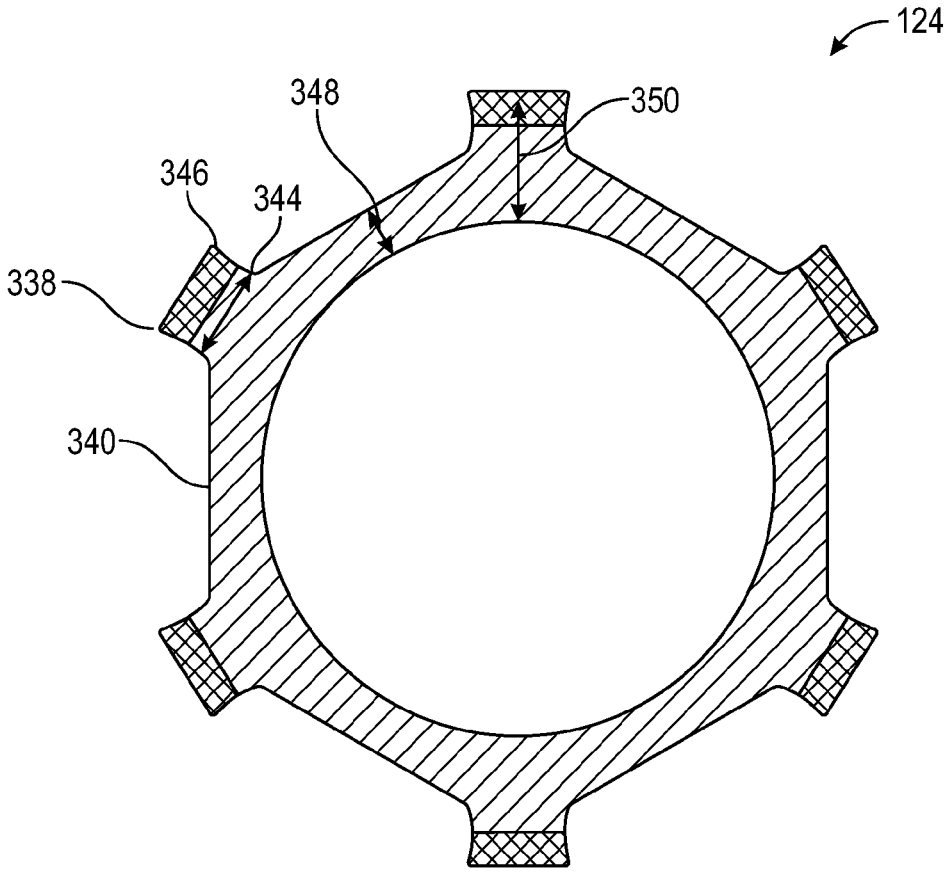
FIG. 3 is an axial view of a gland for a tubing centralizer.

FIG. 3 is an end view of the gland 124, according to one or more embodiments. As illustrated, gland 124 may provide or otherwise define variations in its outer diameter that define alternating lobes 338 and grooves 340. The gland 124 may be generally cylindrical and hollow, thus being able to be arranged on or otherwise mounted to mandrel 122 at gland mounting surface 230 (FIG. 2). Functionally, lobes 338 may stabilize production tubing by providing a point of contact with the adjacent casing and/or wellbore walls during operation, preventing contact with the casing or other production components.

During removal of tubing centralizer 112 from the wellbore 102, lobes 338 on gland 124 may function as a sacrificial material that shears off, enabling the production string to be removed without binding, mechanical damage, or the use of specialized retrieval equipment. In such embodiments, lobes 338 may be made of a shearable (frangible) material or may otherwise be designed to shear and break away from remaining portions of gland 124 upon assuming a predetermined mechanical load. Shearable lobes 338 can provide operational flexibility over other tubing centralizer designs that incorporate cages or metal structures that can collapse or catch on casing or other objects downhole.

As shown in FIG. 3, each lobe 338 may exhibit a profile that extends radially outward, but also extends axially along the length of gland 124. In some embodiments, one or more of lobes 338 may vary in material thickness. More specifically, lobes 338 may have a tapered lobe region 344 that increases in thickness to a lobe apex 346. It is also envisioned that the convention may be reversed, such that the lobe region 344 decreases in thickness to the lobe apex 346, or a combination of the variable thickness lobe 338 designs may be combined into on a single gland 124. In another embodiment, the lobe region 344 may have a substantially constant width from the surface of groove 340 to lobe apex 346.

When emplaced, gland 124 contacts one or more walls within the wellbore, creating a void space defined by the lobes 338 and grooves 340 that allows fluids (and solids in some cases) to travel within the annulus created between the well casing and the production tubing, while also securing the production tubing from mechanical damage. The void space and corresponding permitted flow volume are dependent on the difference between the distance 348 between the inner diameter of the gland 124 and the surface of groove 340, and the distance 350 between inner diameter of the gland 124 and lobe apex 346. Depending on the needs of the application, the void space may be modified by increasing or decreasing distance 348 (effectively the thickness of gland 124), which may be optimized on the basis of material durability of the gland 124, the desired amount of flow rate, presence of drilling solids or unconsolidated formation, and the like.

Figure 4A:
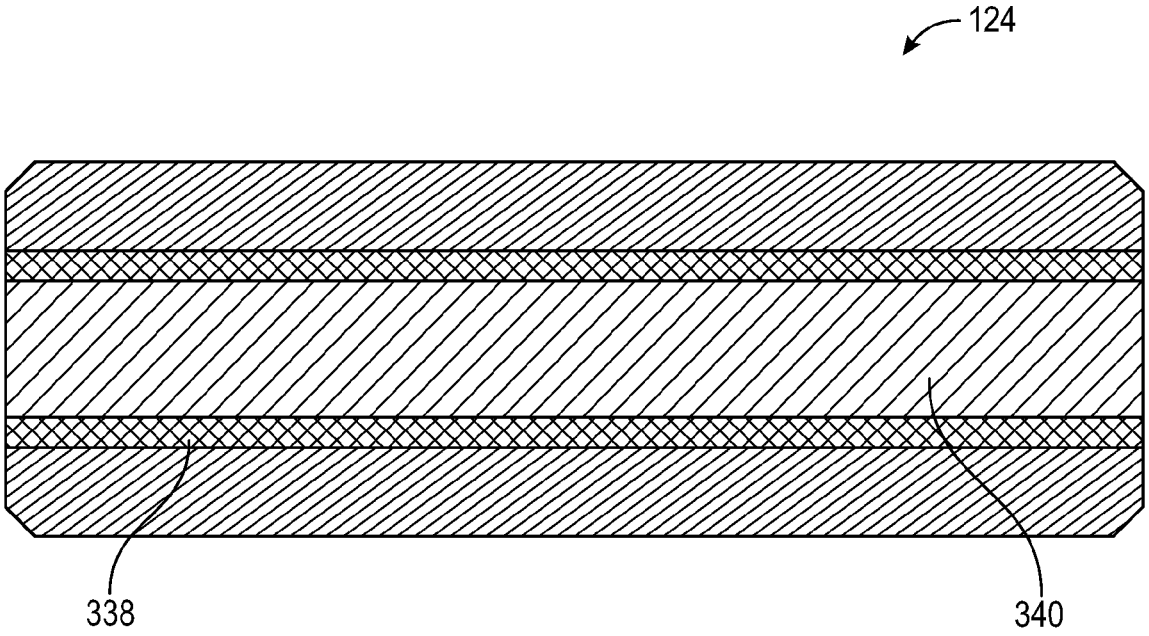
FIG. 4A is an illustration depicting a side view of a gland design having linear lobes and grooves.

In some embodiments, lobes 338 may be equidistantly spaced about the outer circumference of the gland 124. In other embodiments, lobes may be non-equidistantly or randomly distributed (spaced), without departing from the scope of the disclosure. FIG. 3 depicts a gland 124 design having six lobes 338, however, the number may vary based on production tubing diameter, groove shape (e.g., linear or spiral), desired fluid flow rates, solids content of the produced fluids, and the like. In some cases, glands disclosed herein may include two or more lobes (e.g., three, four, five, six, etc.). FIG. 4A is a side view of the gland 124 of FIG. 3, showing a linear arrangement of grooves 340 and lobes 338. In other designs, grooves 340 may also form a spiral (e.g., helix) along the length of the gland 124 having a constant or varied helix angle.

Figure 4B:
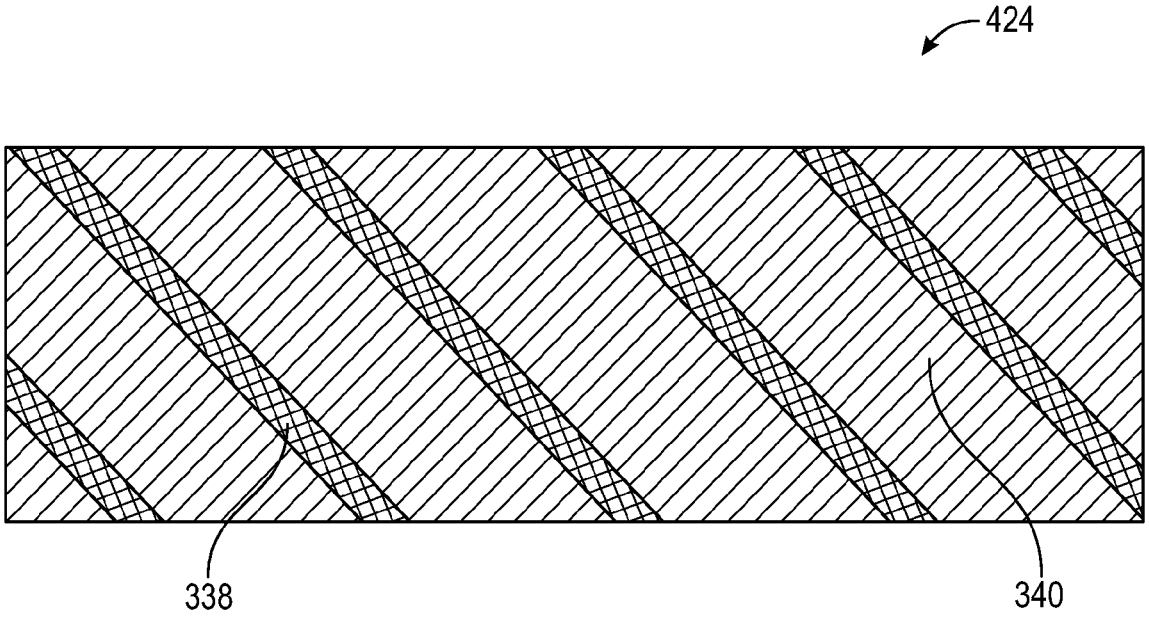
FIG. 4B is an illustration depicting a side view of a gland design having lobes and grooves arranged in a spiralling orientation.

FIG. 4B is a gland 424 similar to gland 124. As illustrated, gland 424 may include or otherwise provide grooves 340 and lobes 338 that extend helically along the length of the gland 424, and at a constant helix angle. In some cases, the helix angle of the grooves 340 may range from about about 0 to about 40 degrees, about 10 to about 40 degrees, and about 10 to about 50 degrees. Glands 124 and 424 may also incorporate varied or varying helix angles, including designs having a large helix angle at a first end that transitions to a smaller helix angle in a central region of the gland 124 and increases toward the second end, and vice versa.

Figure 5:
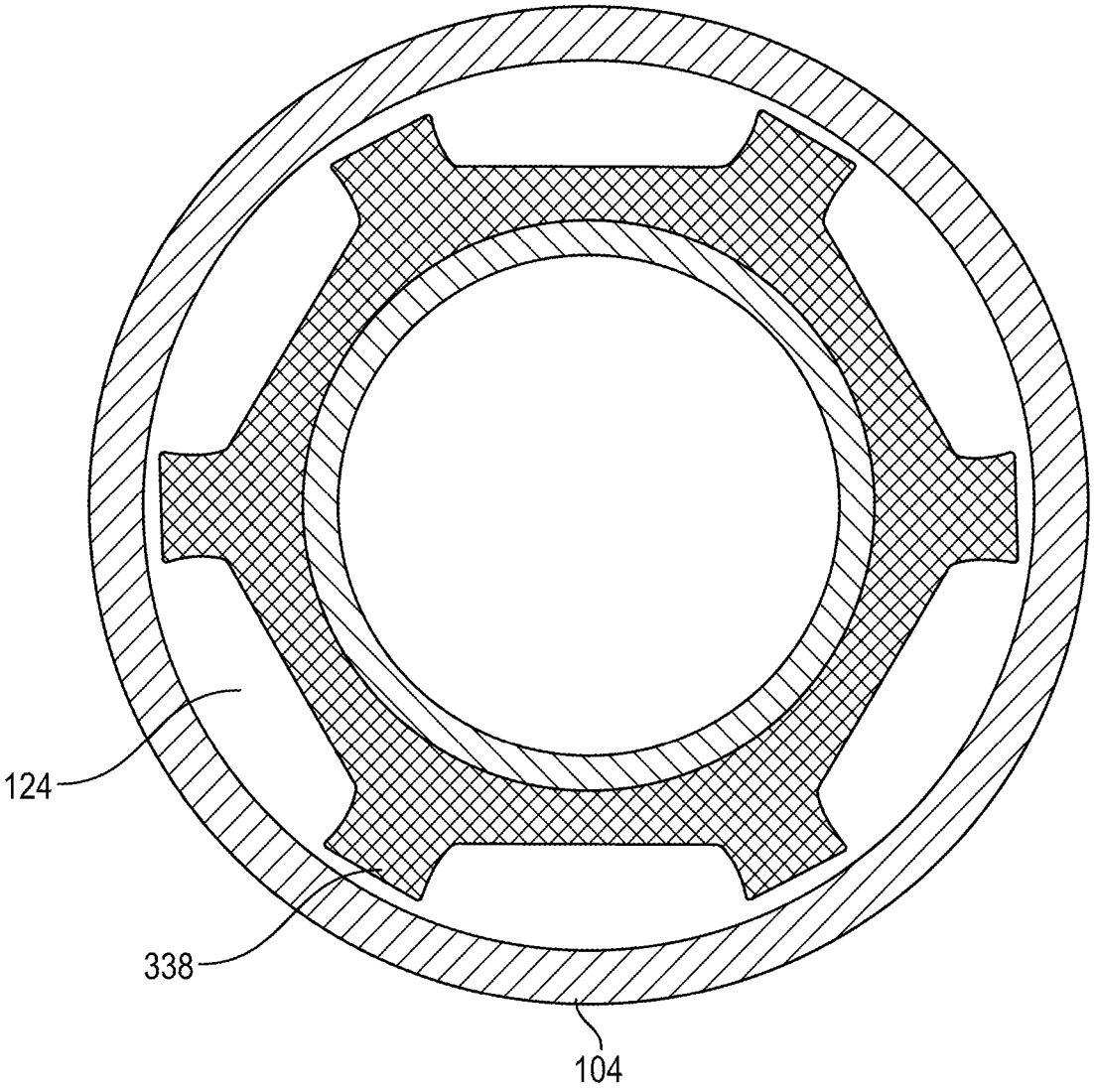
FIG. 5 is an axial view of a tubing centralizer of the present disclosure installed in a cased well.

FIG. 5 is an end view of the gland 124 of FIG. 3 positioned within a well casing 104. Gland 124 may be sized such that one or more lobes 338 engage the inside walls of the well casing 104. The extent of contact dependent on the tolerance between the outer diameter of gland 124 defined by lobes 338 and the inner diameter of the well casing 104. In some cases, the pressure against the casing 104 may prevent unintentional movement of production string 108 (FIG. 1) in the well (due to reciprocating forces during production, for example). Gland 124 designs may also have minimal contact with the well casing 104 in some cases, but be dimensioned such that the outer diameter of lobes 338 are the primary point of contact during motion of the production string 108 to minimize mechanical damage to the production string 108 and well casing 104.

While tubing stabilizer designs discussed above incorporate a gland mounted on a mandrel, it is envisioned that other arrangements are possible. In some embodiments a gland may be applied directly onto full length joints of production tubing. For example, glands could be molded directly onto production tubing, such as by injection molding at a facility prior to installation in the well. Replacement of the glands during servicing may then include the installation of a similar production tubing joint having a gland installed thereon, or other solution such as the tubing centralizer designs disclosed above.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of"or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, and the like are used in relation to the illustrative embodiments as they are depicted in the figures, the upward direction being toward the top of the corresponding figure and the downward direction being toward the bottom of the corresponding figure.

What is claimed is:

1. A centralizer for stabilizing production tubing within a well, the centralizer comprising:

a mandrel having a first end configured to be coupled to an upper section of production tubing and a second end configured to be coupled to a lower section of the production tubing;

a gland mounting surface defined on the mandrel and comprising a reduced-diameter section of the mandrel that terminates at a radial shoulder;

a gland mountable to the gland mounting surface and having a cylindrical body and two or more lobes extending radially outward from the cylindrical body; and a lower coupling coupled to the second end of the mandrel to secure the gland between the lower coupling and the radial shoulder.

2. The centralizer of claim 1, wherein the two or more lobes include an abrasion resistant material selected from the group consisting of a polymer, a copolymer, a composite material, a ceramic, a metal, and any combination thereof.

3. The centralizer of claim 1, wherein the mandrel and the gland are constructed from the same material.

4. The centralizer of claim 1, wherein the two or more lobes are separated by linear grooves defined along an axial length of the gland.

5. The centralizer of claim 1, wherein the two or more lobes define a helix angle along an axial length of the gland.

6. The centralizer of claim 5, wherein the helix angle varies along the axial length of the gland.

7. The centralizer of claim 1, wherein the lobes are dimensioned to engage casing within the well.

8. The centralizer of claim 1, wherein the lower coupling is threaded to the mandrel at the second end.

9. The centralizer of claim 1, wherein the gland is rotatably mounted to the gland mounting surface such that the gland is capable of rotating relative to the mandrel.

10. The centralizer of claim 1, wherein the mandrel comprises a circumferentially continuous tubular structure.

11. The centralizer of claim 1, wherein at least one of the two or more lobes exhibits a cross-sectional width that varies as extending radially outward from the cylindrical body.

12. A method for stabilizing production tubing, comprising:

positioning a centralizer within a cased interval of a wellbore, the centralizer including:

a mandrel having first and second ends coupled to upper and lower sections, respectively, of the production tubing;

a gland mounting surface defined on the mandrel and comprising a reduced-diameter section of the mandrel that terminates at a radial shoulder;

a gland mounted to the gland mounting surface and having a cylindrical body and two or more lobes extending radially outward from the cylindrical body; and a lower coupling coupled to the second end of the mandrel to secure the gland between the lower coupling and the radial shoulder engaging an inner wall of the cased interval with the two or more lobes and thereby centralizing the production tubing within the cased interval.

13. The method of claim 12, wherein the two or more lobes include an abrasion resistant material selected from the group consisting of a polymer, a copolymer, a composite material, a ceramic, a metal, and any combination thereof.

14. The method of claim 12, further comprising freely rotating the gland on the gland mounting surface relative to the mandrel as the gland engages the inner wall of the cased interval.

15. A downhole assembly comprising:

a production string extendable within a cased well;

a tubing anchor catcher positioned within the production string;

a downhole pump coupled to the production string and located axially below the tubing anchor catcher; and a centralizer coupled to the production string, the centralizer comprising:

a mandrel having first and second ends coupled to upper and lower sections, respectively, of the production string;

a gland mounting surface defined on the mandrel and comprising a reduced-diameter section of the mandrel that terminates at a radial shoulder;

a gland mounted to the gland mounting surface and providing a cylindrical body and two or more lobes extending radially outward from the cylindrical body; and a lower coupling coupled to the second end of the mandrel to secure the gland between the lower coupling and the radial shoulder.

16. The downhole assembly system of claim 15, wherein the gland freely rotates on the gland mounting surface.

17. The downhole assembly system of claim 15, wherein the centralizer is located axially between the tubing anchor catcher and the downhole pump.

18. The downhole assembly system of claim 15, wherein the centralizer is a first centralizer and the downhole assembly includes a second centralizer coupled to the production string.

19. The downhole assembly system of claim 15, wherein the two or more lobes include an abrasion resistant material selected from the group consisting of a polymer, a copolymer, a composite material, a ceramic, a metal, and any combination thereof.

* * * * *